US011414922B2

(12) United States Patent
Nixon

(10) Patent No.: US 11,414,922 B2
(45) Date of Patent: Aug. 16, 2022

(54) MITRED CORNERED FRAME CLAMP

(71) Applicant: Matki PLC, Bristol (GB)

(72) Inventor: Ross Nixon, Somerset (GB)

(73) Assignee: Matki PLC, Bristol (GB)

( * ) Notice: Subject to any disclaimer, the term of this patent is extended or adjusted under 35 U.S.C. 154(b) by 96 days.

(21) Appl. No.: 16/956,633

(22) PCT Filed: Dec. 21, 2018

(86) PCT No.: PCT/GB2018/053751
§ 371 (c)(1),
(2) Date: Jun. 22, 2020

(87) PCT Pub. No.: WO2019/122925
PCT Pub. Date: Jun. 27, 2019

(65) Prior Publication Data

US 2021/0010322 A1 Jan. 14, 2021

(30) Foreign Application Priority Data

Dec. 21, 2017 (GB) ..... 1721620

(51) Int. Cl.
*E06B 3/96* (2006.01)
*E06B 3/964* (2006.01)
(Continued)

(52) U.S. Cl.
CPC ..... *E06B 3/9646* (2013.01); *E06B 3/9688* (2013.01); *E06B 3/9885* (2013.01)

(58) Field of Classification Search
CPC ..... E06B 3/9646; E06B 3/9685; E06B 3/9688
(Continued)

(56) References Cited

U.S. PATENT DOCUMENTS 4,527,364 A * 7/1985 Baus ..... F16B 12/50 52/127.7
6,807,783 B2 * 10/2004 Lee ..... E06B 1/34 52/211
(Continued)

FOREIGN PATENT DOCUMENTS

DE 1976005 U 12/1967
DE 1997871 U 12/1968
(Continued)

OTHER PUBLICATIONS

International Search Report, European Patent Office, dated Mar. 20, 2019.
(Continued)

*Primary Examiner* — Brian E Glessner
*Assistant Examiner* — James J Buckle, Jr.
(74) *Attorney, Agent, or Firm* — Bay State IP, LLC

(57) ABSTRACT

A mitred corner of a frame has a clamp 1 clamping together a top member 2 and a side member 3. The corner is at a corner of a glass panel 4 accommodated within a frame made up of four such members, each clamped together by similar clamps. The frame members are mitred at 45° with faces 8. Webs 7 of the frame members are drilled with bores 9 fixing screws 10 The screws engage in two clamp elements are used at each corner, in the form of stainless steel blocks 12,13.

The block 12 has at its end close to the mitre faces 8, a 45° surface 17 and a threaded end bore 19 is provided. The block 13 has a finger 24 extending past the face 8. The finger has a clearance screw bore 25 and at its distal end a snib 26 directed towards the block 12.

17 Claims, 8 Drawing Sheets

(51) Int. Cl.
*E06B 3/968* (2006.01)
*E06B 3/988* (2006.01)

(58) Field of Classification Search
USPC ..... 52/656.9
See application file for complete search history.

(56) References Cited

U.S. PATENT DOCUMENTS

| | | | | |
|---|---|---|---|---|
| 8,356,446 | B2 * | 1/2013 | Takeda | E04B 1/5831 52/79.12 |
| 8,474,213 | B2 * | 7/2013 | Oetlinger | E05D 5/0238 52/655.1 |
| 8,584,426 | B2 * | 11/2013 | Valier | E06B 3/549 52/656.5 |
| 2005/0193680 | A1 * | 9/2005 | Wang | E06B 3/9688 52/656.9 |
| 2016/0281415 | A1 * | 9/2016 | Massey | E06B 3/9632 |

FOREIGN PATENT DOCUMENTS

| | | | | |
|---|---|---|---|---|
| DE | 9416529 | U1 | 2/1996 | |
| EP | 0846831 | A1 | 6/1998 | |
| FR | 2729738 | A1 * | 7/1996 | E06B 3/9646 |
| GB | 1571595 | A | 7/1980 | |

OTHER PUBLICATIONS

International Report on Patentability, European Patent Office, dated Mar. 13, 2019.

* cited by examiner

MITRED CORNERED FRAME CLAMP

CROSS REFERENCE TO RELATED APPLICATION

This application is for entry into the U.S. National Phase under § 371 for International Application No. PCT/GB2018/053751 having an international filing date of Dec. 21, 2018, and from which priority is claimed under all applicable sections of Title 35 of the United States Code including, but not limited to, Sections 120, 363, and 365(*c*) and which in turn claims priority under 35 USC 119 to UK Patent Application No. 1721620.1 filed on Dec. 21, 2017.

The present invention relates to a clamp for a mitred cornered frame, particularly though not exclusively for a shower enclosure.

Mitred corners in frames having extruded or uniform cross-section members are common. Wooden picture frames have plain mitres and are nailed. For more strength they can have tongues along the mitre or transverse it. Extrusions often have L pieces fitted in grooves in the extrusion and secured with screws. It is known to thread one member axially of its extrusion at the mitre and engage a screw transversely of the other member in the thread to clamp the members together.

Mitred corner frames for shower enclosures can be subject to considerable load, especially in a door, the load being from the weight of a framed glass panel.

The object of the present invention is to provide an improved clamp for a mitred cornered frame.

According to the invention there is provided a clamp for two mitred-end, frame members of a mitred corner frame, the clamp being adapted to be fastened by a fastener and comprising:

- a first clamp element adapted to be fitted to a first, mitred-end, frame member, the first clamp element having:
  - an oblique surface at least partially directed, in use, transverse to a mitred-end face of the first frame member and
  - a first fastening provision and
- a second clamp element adapted to be fitted to a second, mitred-end, frame member, the second clamp element having:
  - a finger arranged to extend, in use, beyond the mitred-end of the second frame member and having:
    - an oblique surface at least partially directed, in use, transverse to a mitred-end face of the second frame member and
    - a second fastening provision arranged, in use, complementarily to the first fastening provision for urging the clamp elements towards each other in a fastening direction via action of the fastener engaging the fastening provisions,
- the arrangement being such that upon fastening the oblique surfaces co-operate to move the clamp elements orthogonally of the fastening direction to close the faces of the two mitred-end, frame members against each other.

Whilst one or other or both of the oblique surfaces can be curved, with mutual contact areas directed transverse to the faces of the mitred members; preferably they are flat. Normally the flat surfaces will be substantially at right angles to the mitred faces. These will normally be at 45° to the length of their members. Nevertheless, in it can be envisaged that they may be at other angles, particularly where the members are of unequal widths.

Further, the oblique surfaces will normally be at between 30° and 60°, and preferably substantially at 45°, to the length of their respective clamp elements Where the fastener is threaded, in particular a bolt or screw, the fastening provisions are that the first clamp member has a threaded bore and the second clamp element has a clearance bore. As an alternative the threaded bore could be plain where the fastener is self-tapping.

Alternatively the fastening provisions can be for alternative fasteners such as a wedge or pin engaging in a tongue or other projection of the first clamp element passing through a slot or other aperture in the second clamp element, the pin or wedge engaging in the tongue on the side of second clamping element remote from the first.

In the preferred embodiment, the finger has a snib extending towards the first clamp element and having the second clamp element's oblique surface. Tightening of the fastener biases the snib to slide on the first clamp element, with their oblique surfaces sliding in a direction to close the mitred-ends against each other.

Preferably, either of the clamp elements in a pair, and conveniently the second, is provided with an abutment arranged to react locally against an edge of the panel in the frame to adjust any angular misalignment of the mitred faces for adjustment of frame squareness. Conveniently the abutments are grub screws in threaded bores. They can react directly or via an intervening piece. Preferably, the grub screws have soft, plastics material tips for abutting a glass panel. Alternative panel abutments and formations therefor can be envisaged.

The clamp elements, in particular the first ones, which will normally be at side of their frame in use, are provided with plain and/or thread bores for other fasteners such as hinge screws and fixed panel connectors.

Preferably the clamp is provided in combination with a wall-securement channel member within which at least one of the clamp elements is adapted to be received, the one clamp element being provided with a lateral bore for receiving a channel fixing screw.

In combination with respective mitred-end frame members, the clamp members having their lengths parallel with lengths of the respective frame members. They can be adapted to be fitted to webs of the members which extend inside the elements or outside them. Preferably they have both inner and outer faces for abutting with inner and outer webs as required. The first clamp element is conveniently formed with a pair of oblique surfaces whereby it can be fitted either way around.

Normally the frame will comprise four mitred-end members, with four pairs of first and second clamp elements and a panel accommodated in the frame. The panel can be glass, with a peripheral seal between the glass panel and the frame members.

The mitred-end frame members can have generally H sections, with the clamp elements being without webs of the H sections. Alternatively, certain, particularly top and bottom, mitred-end frame members can have a generally H section and the others can have a generally U section with one said clamp element at each corner without the H section and the other said clamp element being within the U section.

To help understanding of the invention, various embodiments thereof and variants will now be described by way of example and with reference to the accompanying drawings, in which.

Figure 1:
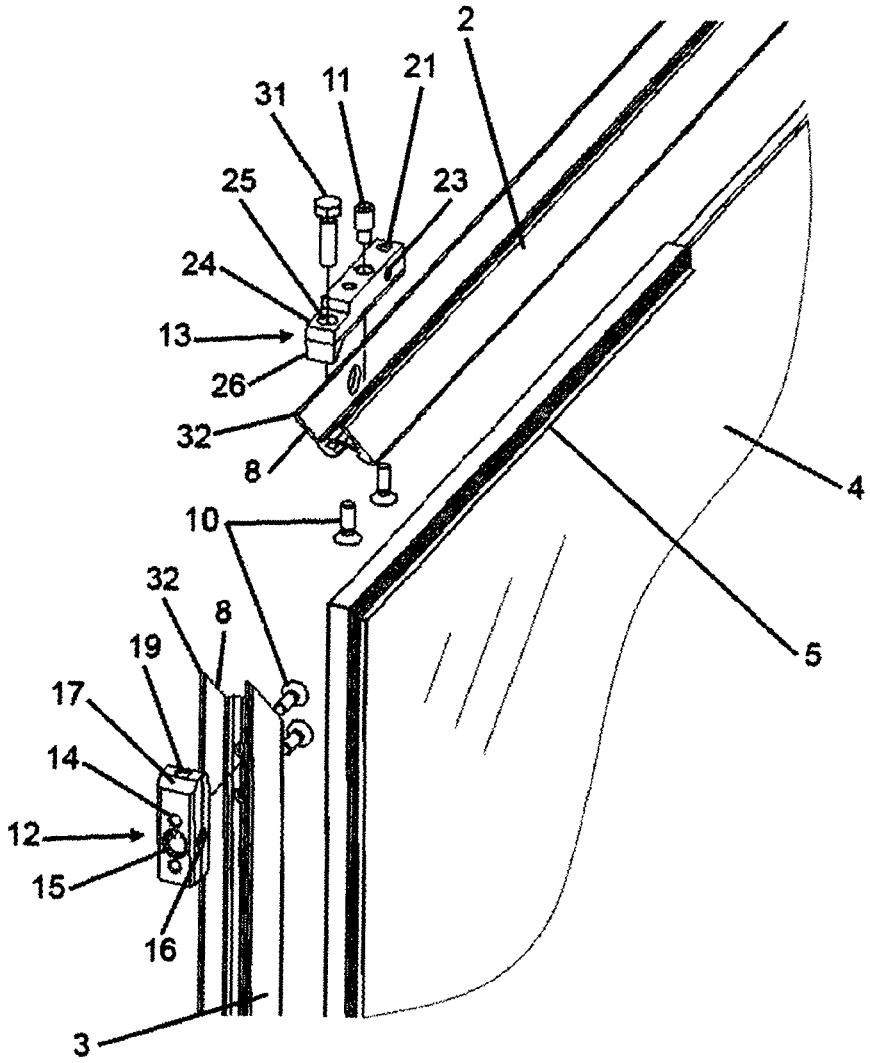
FIG. 1 is an exploded perspective view of a mitred corner frame clamp in accordance with the invention.

Referring to the drawings, it should be noted that the drawings show one corner only in each case of a frame clamped together with clamps in accordance with the invention.

Figure 2:
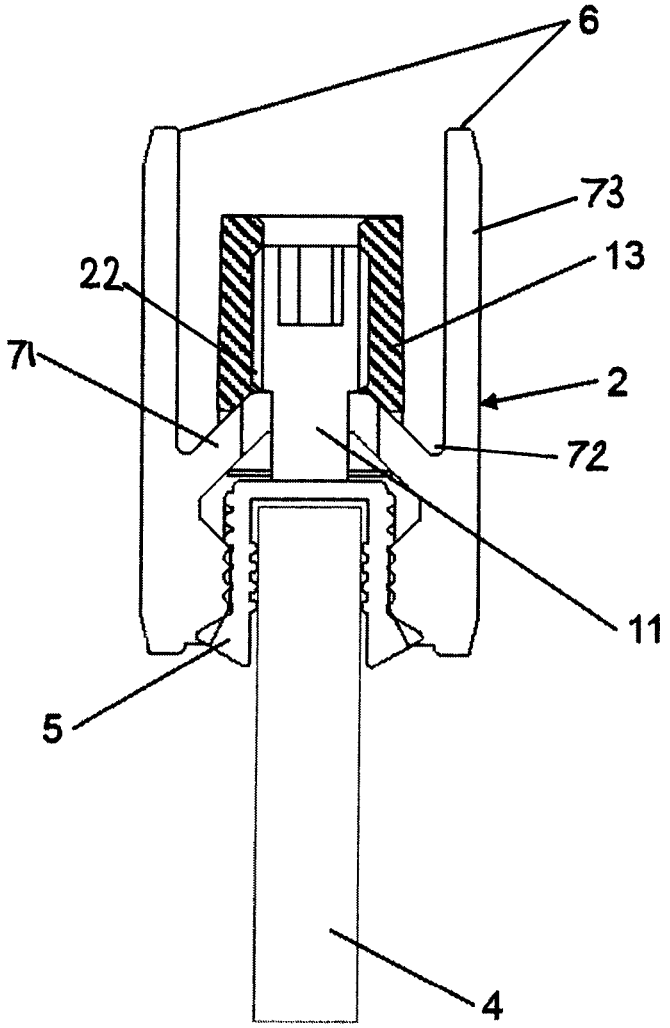
FIG. 2 is a cross-sectional end, scrap view through an adjustment grub screw shown in FIG. 1.
Figure 3:
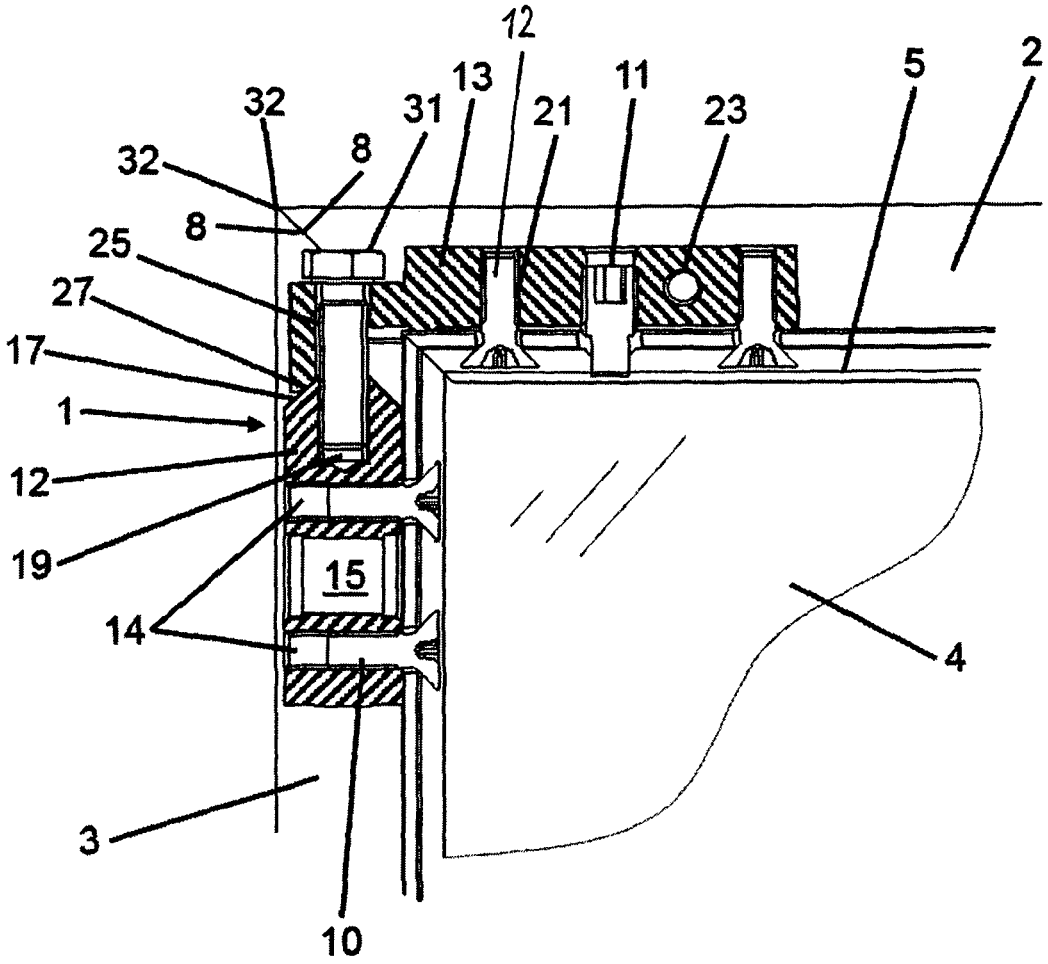
FIG. 3 is a cross-sectional side view of the clamp of FIG. 1.

Turning to FIGS. 1, 2 and 3, a mitred corner of a frame has a clamp 1 clamping together a top member 2 and a side member 3. The corner is at a corner of a glass panel 4 accommodated within a frame made up of four such members, each clamped together by similar clamps. A gasket 5 extends around the glass and is sandwiched between the glass and the frame members.

The frame members are H-section brass extrusions with flanges 6 and an outwardly ridged web 7. They are mitred at 45° with faces 8 and can be cut to close tolerances, such that when the frame is assembled all four corners can abut with negligibly visible joints.

The joint at one corner is shown and will be described. At distances determined in accordance with threaded bores in clamp elements to be described, the webs 7 are drilled with bores 9 for stainless steel fixing screws 10 and a grub screw 11 to be described below.

Two clamp elements are used at each corner, in the form of stainless steel blocks 12,13, which are grooved complementarily to the web 7. The block 12 for side frame members is of generally rectangular section, with relieved corners. It has threaded bores 14 for its fixing screws 10, with an open bore 15 between the bores 14 and a threaded cross bore 16 opening into the open bore. At its end close to the mitre faces 8, the block has two 45° surfaces 17 at inner and outer corners of the block, the two 45° surfaces 17 are provided to enable the block to function when mated at one side with the ridged web 7 or at the other with a plain-bottomed, channel shaped frame member, such as frame member 61 shown in FIG. 6. Between the surfaces 17, and a threaded end bore 19 is provided.

The block 13 for the top member is superficially similar, but different in detail. It has threaded fixing bores 21 for its fixing screws 10 and a threaded bore 22 between for the grub screw 11. A threaded cross bore 23 is also provided. At its mitre face end, it has a finger 24 extending past the face 8. The finger has a clearance screw bore 25 and at its distal end a snib 26 directed towards the block 12. The snib has an oblique face 27, angled complementarily to the angled face 17 with which it abuts as now described. It will be noted that the faces 17,27 are at right angles to the faces 8, whereby sliding of the faces 17,27 moves the faces 8 together or apart.

A further feature of the block 13 is that its underside is machined with mitred lips 131. These are complementary with the outward ridging 71 of the web 7, providing grooves 72 at roots of its web with flanges 73 of it for co-operating with the clamp element lips 131 for centring the one clamp element on the web.

For assembly of the corner, with the glass panel and the gasket in place, the blocks 12,13 have already been attached by their fixing screws 10. They determine the correct positioning of the blocks with respect to the mitre faces 8. A screw 31 is passed through the finger 24 at the bore 25 and engaged in the threaded end bore of the block 12. This assembly is likely to be carried out at the same time as a corresponding assembly at the opposite end of the top member 2. The screws pull the top members laterally and the side members 3 towards each other. The faces 8 are nominally parallel. They close together as the faces 17,27 close together. Final closure cause sliding of the faces 17,27 on each other with direct abutment of the faces 8. The points 32 of the mitred members 2,3 will be coincident as a result of accurate machining.

Under certain circumstances, particularly where the glass panel is slightly undersize with respect to the internal spacing of the web of the side members and the top & bottom members of the frame, allowing for the gasket, and in particular where the gasket is tight in the frame and on the glass, the tightening of the screws 31 can result in the frame coming together as a parallelogram slightly off rectangular. Rectangularity can be adjusted via the grubs 11. The pair of corners which have too open angles, with contact of their faces 8 at the points 32, can be adjusted by winding their grub screws against the glass moving the corresponding side members along the edges of the glass to close the faces more evenly. It may be necessary to release the screws 31 slightly before such adjustment and close them again afterwards. This adjustment should result in the other corners being opened with contact at the inner ends of the faces 8 becoming more even. The adjustment can be made progressively. Once finished, all the grub screws should be tightened evenly against the glass, preferably after even tightening of the main screws 31.

Figure 4:
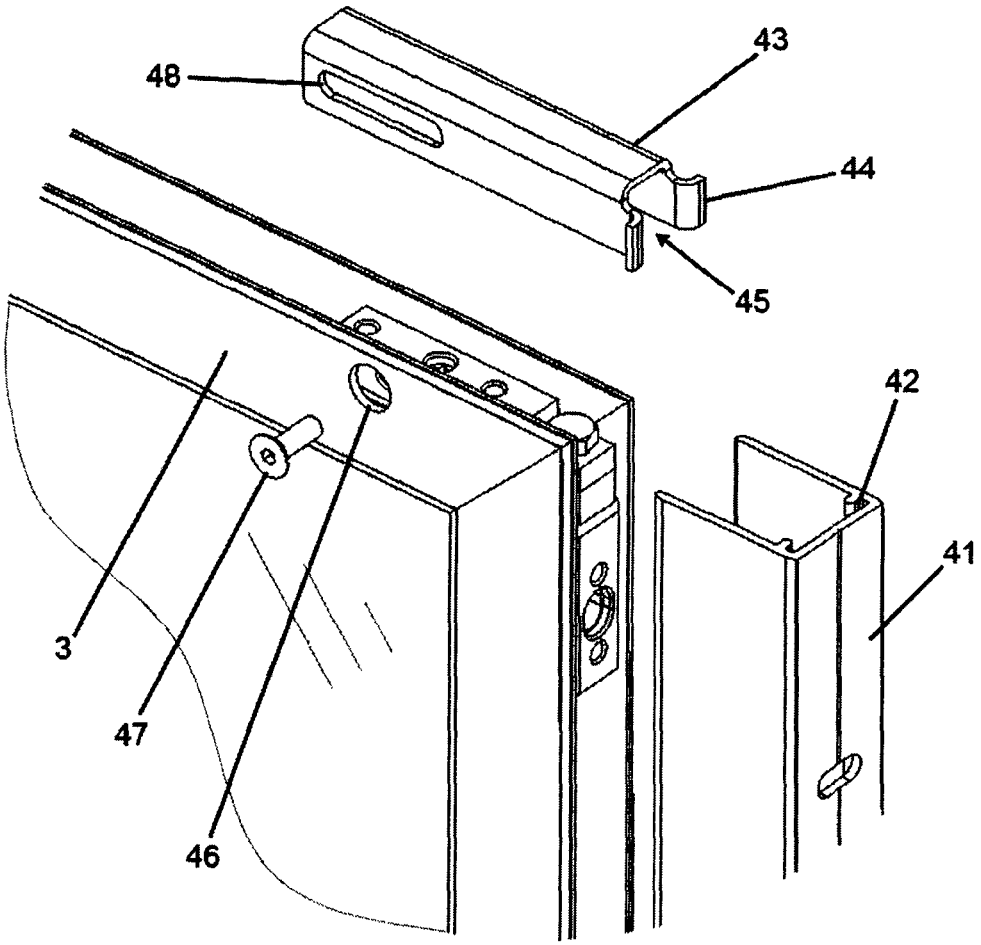
FIG. 4 is an exploded perspective view of components for wall fitting of the corner of FIG. 1.

Turning now to FIG. 4, where a complete frame is to be secured to a wall, a frame receiving channel 41 is secured to it first. It has rebates 42 running on either side at its roots. A formed member 43 has tongues 44 to engage in the rebates and a channel 45 that fits over—or under as the case may be—the block 13. The members 3 have drillings 46 opposite the cross bores 23. Screws 47 can pass through these and slots 48 in the channels, whereby the channels can be fastened to the blocks to hold the frames partially within the channel 41.

Figure 5:
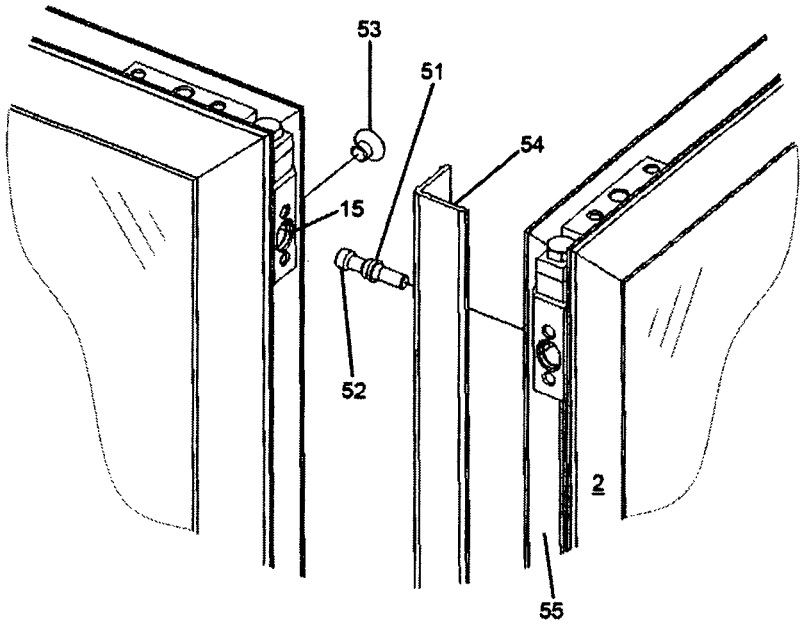
FIG. 5 is a similar exploded perspective view of components for angle fitting of two corners of FIG. 1.

As shown in FIG. 5, where two panels are to be connected at right angles, connectors 51 can be screwed into the threaded bores 16 of the blocks of one frame, with suitable drilling of the member 2. The connectors have undercut heads 52 which pass into the bores 15 of the other frames' blocks 12. They are held there by screws 53 engaging in those blocks threaded bores 16. An angle section 54 is captive between the panels to close the frame member 2, which would otherwise have its rebate 55 exposed.

Figure 6:
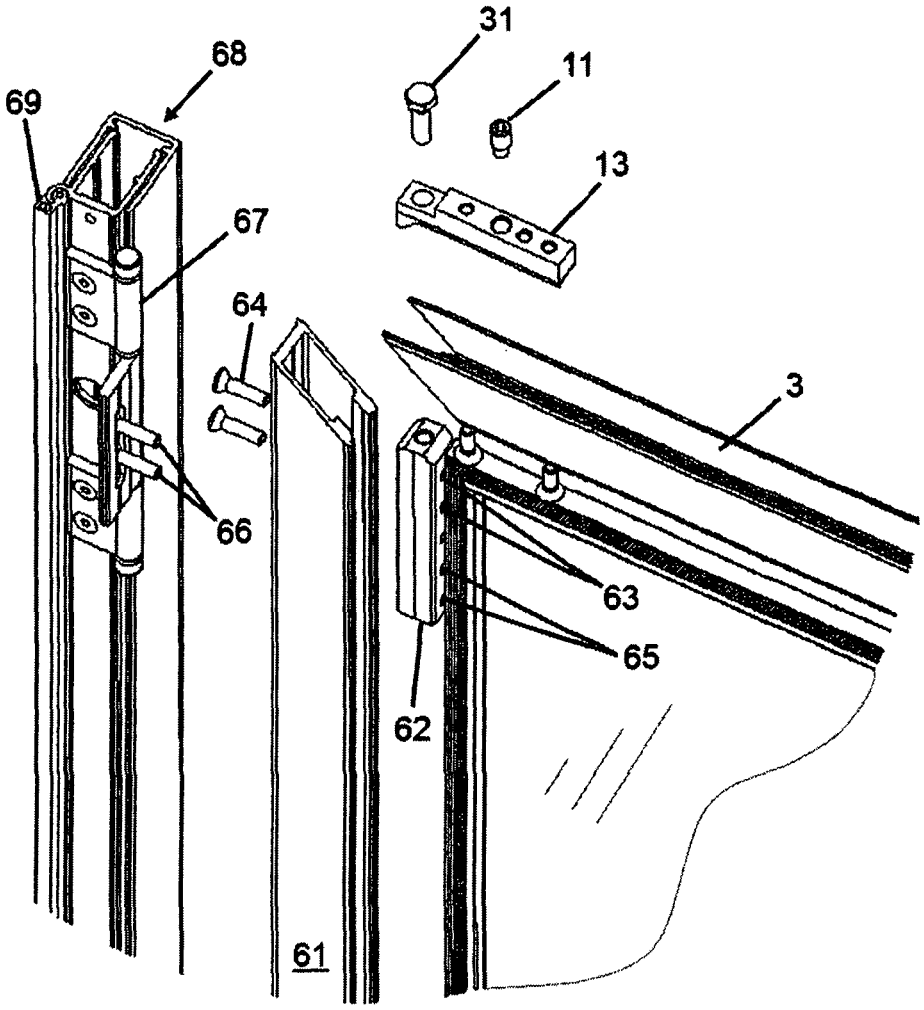
FIG. 6 is a view similar to FIG. 1, but from a different angle, of a varied corner adapted for hinging of the corner.
Figure 7:
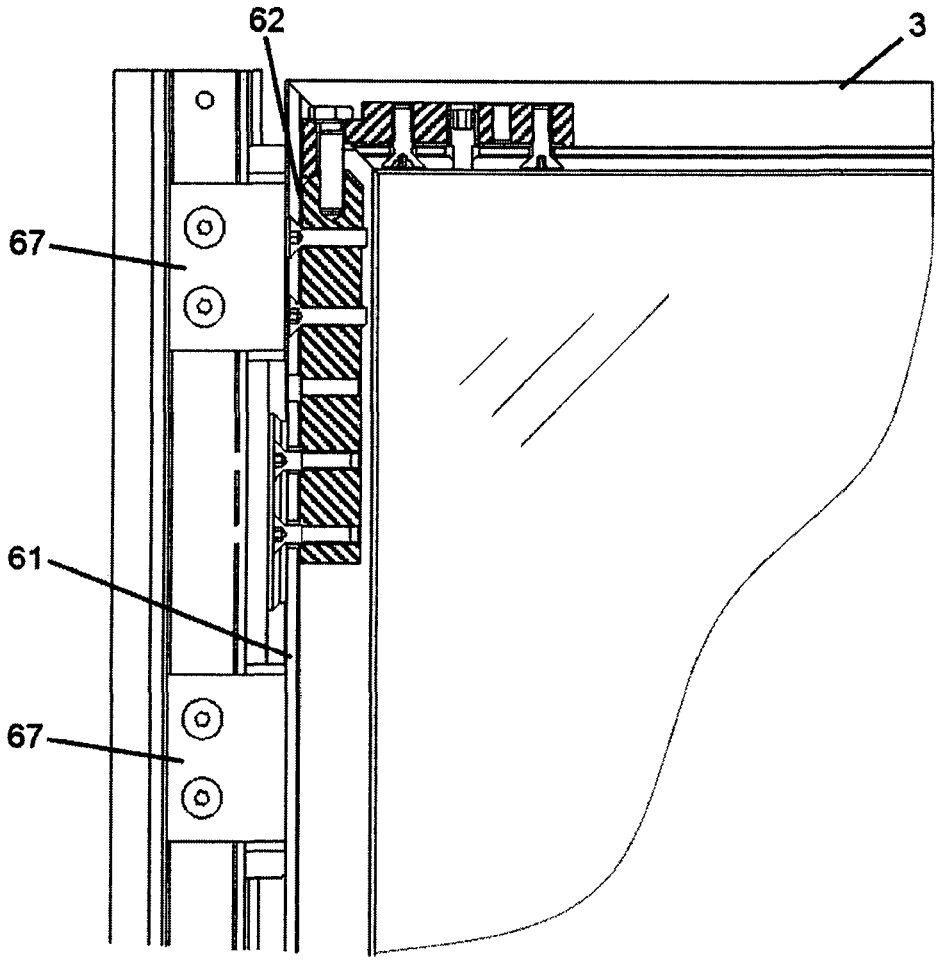
FIG. 7 is a view similar to FIG. 3 of the varied hinged corner of FIG. 6.
Figure 8:
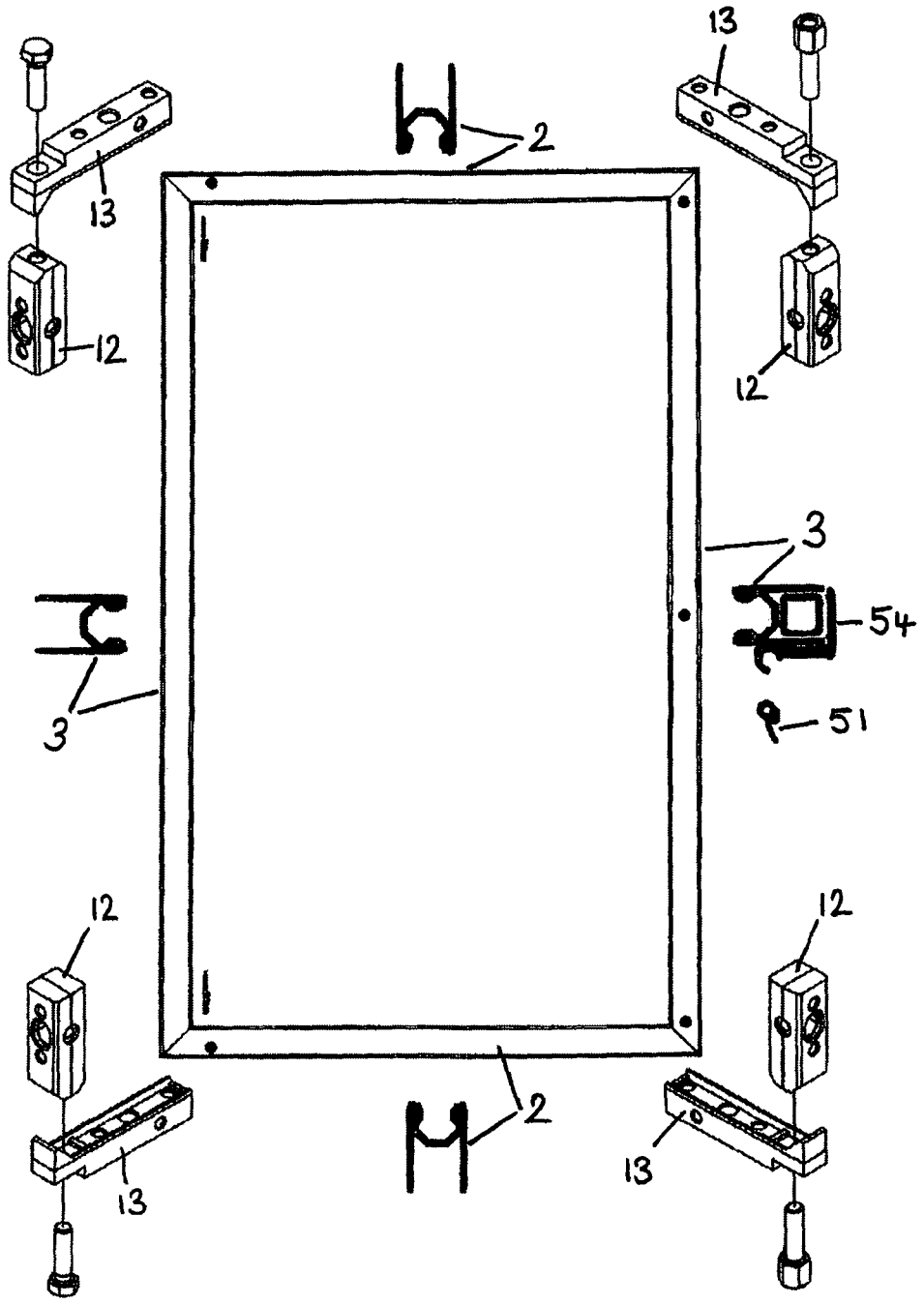
FIG. 8 is a diagrammatic view of the constituent parts of a clamped frame and glass panel in accordance with the invention.

For frame hinging as shown in FIGS. 6 & 7, two different components are used. The upright side members 61 on both side edges of the doors are channel members in place H section members. Further the blocks 62 are longer and have five threaded holes. The upper pair 63 receive screws 64 for holding the blocks in the channel 61; whilst the lower ones 65 receive screws 66 fastening a hinge 67 to the frame. The fifth threaded hole is spare. The wall side of the hinge is secured to a complementary pair of nested channels 68 secured to a wall. The inner channel is adjustable as required and has a seal 69 for the door.

The invention claimed is:

1. A clamp and frame combination for two mitred-end, frame members of a mitred corner frame, the clamp being adapted to be fastened by a fastener and comprising:

a first clamp element (12) adapted to be fitted to a first, mitred-end, frame member (3), the first clamp element (12) having:

an oblique surface (17) at least partially directed, in use, transverse to a mitred-end face (8) of the first frame member (3) and a first fastening provision (19) and a second clamp element (13) adapted to be fitted to a second, mitred-end, frame member (2), the second clamp element (13) having:

a finger (24) arranged to extend, in use, beyond the mitred-end of the second frame member (2) and having:

an oblique surface (27) at least partially directed, in use, transverse to a mitred-end face (8) of the second frame member (2) and a second fastening provision (25) arranged, in use, complementarily to the first fastening provision (19) for urging the clamp elements (12,13) towards each other in a fastening direction via action of the fastener (31) engaging the fastening provisions (19, 24), the arrangement being such that upon fastening, the oblique surfaces (17, 27) co-operate to move the clamp elements (12,13) orthogonally of the fastening direction to close the faces (8) of the two mitred-end, frame members (2, 3) against each other, and wherein at least one of the clamp elements is provided with a panel-abutment formation (22) adapted and arranged to abut a panel (4) in a mitred corner frame for adjustment of frame squareness; wherein the clamp in combination with respective mitred-end frame members (2,3), the clamp elements have their lengths parallel with lengths of the respective frame members; wherein the clamp in combination with respective mitred-end frame members (2,3) further include: four said mitred-end frame members; four said first clamp elements; four said second clamp elements; and a panel and a panel surrounding seal; wherein the frame members are arranged as a frame around the panel and clamped together with the clamp elements; wherein the clamped frame and panel is a fixed side or a door of a shower enclosure; and wherein the clamped frame and panel is in combination with: another such clamped frame and panel; a frame member closure angle (54); a pair of frame connectors (51) fastened in two of the clamp elements of the clamped frame and panel; and a pair of captivating screws captivating the connectors in two of the clamp elements of the other clamped frame and panel.

2. The clamp and frame combination according to claim 1, wherein one or other or both of the oblique surfaces are curved, with mutual contact areas directed transverse to the faces of the mitred members.

3. The clamp and frame combination according to claim 1, wherein one or other or both of the oblique surfaces (17, 27) are flat.

4. The clamp and frame combination according to claim 3, wherein the oblique surfaces (17, 27) are, in use, at least substantially at right angles to the mitred faces.

5. The clamp and frame combination according to claim 4, wherein the oblique surfaces (17, 27) are at between 30 and 600, and substantially at 450, to the length of their respective clamp elements.

6. The clamp and frame combination according to claim 1, wherein the fastening provisions are: "for the fastener to be threaded and that" the first clamp member (12) has a threaded bore (19) and the second clamp element (13) has a clearance bore (25).

7. The clamp and frame combination according to claim 1, wherein the fastening provisions are: "for the fastener to be plain and that" the first clamp element has an aperture and the second clamp element has a projection adapted to protrude through the aperture and be engaged by the fastener.

8. The clamp and frame combination according to claim 1, wherein the finger (24) has a snib (26) extending, in use, towards the first clamp element and having the second clamp element's oblique surface (27).

9. The clamp and frame combination according to claim 1, wherein the panel-abutment formation (22) is a threaded bore for a grub screw.

10. The clamp and frame combination according to claim 1, wherein at least one of the clamp elements is provided with: "bores (63) for frame-hinge screws and/or" bores (15) for frame connectors and orthogonal bores for connector captivating screws (53).

11. The clamp and frame combination according to claim 1, in combination with a wall-securement channel member (43) within which at least one of the clamp elements is adapted to be received, the one clamp element being provided with a lateral bore for receiving a channel fixing screw (53).

12. The clamp and frame combination according to claim 1, wherein: "both mitred-end frame members have generally H sections, with the clamp elements without webs of the H sections or" one mitred-end frame member has a generally H section and the other mitred-end frame member has a generally U section with one said clamp element without the H section and the other said clamp element being within the U section.

13. The clamp and frame combination according to claim 1, wherein the clamp members are fastened to the frame members with screws (10,12; 64) passing through webs (7) of the frame members to engage in bores (14,21; 63) in the clamp members.

14. The clamp and frame combination according to claim 13, wherein at least one of the clamp elements has lateral centering lips (131) and its frame member has complementary grooves (72) at roots of its web (7) with flanges (73) of it for co-operating with the clamp element lips (131) for centering the one clamp element on the web.

15. The clamp and frame combination according to claim 13, wherein at least one of the clamp elements has a width complementary with a width of its web between flanges of it for centering the clamp element on the web.

16. A clamp and frame combination for two mitred-end, frame members of a mitred corner frame, the clamp being adapted to be fastened by a fastener and comprising:

a first clamp element (12) adapted to be fitted to a first, mitred-end, frame member (3), the first clamp element (12) having:

an oblique surface (17) at least partially directed, in use, transverse to a mitred-end face (8) of the first frame member (3) and a first fastening provision (19) and a second clamp element (13) adapted to be fitted to a second, mitred-end, frame member (2), the second clamp element (13) having:

a finger (24) arranged to extend, in use, beyond the mitred-end of the second frame member (2) and having:

an oblique surface (27) at least partially directed, in use, transverse to a mitred-end face (8) of the second frame member (2) and a second fastening provision (25) arranged, in use, complementarily to the first fastening provision (19) for urging the clamp elements (12,13) towards each other in a fastening direction via action of the fastener (31) engaging the fastening provisions (19, 24), the arrangement being such that upon fastening, the oblique surfaces (17, 27) co-operate to move the clamp elements (12,13) orthogonally of the fastening direction to close the faces (8) of the two mitred-end, frame members (2, 3) against each other, and wherein at least one of the clamp elements is provided with a panel-abutment formation (22) adapted and arranged to abut a panel (4) in a mitred corner frame for adjustment of frame squareness;

wherein the clamp in combination with respective mitred-end frame members (2,3), the clamp elements have their lengths parallel with lengths of the respective frame members;

wherein the clamp in combination with respective mitred-end frame members (2,3) further include:

four said mitred-end frame members;

four said first clamp elements;

four said second clamp elements; and a panel and a panel surrounding seal;

wherein the frame members are arranged as a frame around the panel and clamped together with the clamp elements;

wherein the clamped frame and panel is a fixed side or a door of a shower enclosure; and wherein the clamped frame and panel is in combination with:

another such clamped frame & panel or a hinge fixture member (68), at least two hinges (67):

the hinges being fastened to one of the clamped frames and panels by screws (64) engaging in respective ones of the clamp elements and the hinges being further fastened to the other clamped frame and panel in like manner or to the hinge fixture member.

17. A clamp and frame combination for two mitred-end, frame members of a mitred corner frame, the clamp being adapted to be fastened by a fastener and comprising:

a first clamp element (12) adapted to be fitted to a first, mitred-end, frame member (3), the first clamp element (12) having:

an oblique surface (17) at least partially directed, in use, transverse to a mitred-end face (8) of the first frame member (3) and a first fastening provision (19) and a second clamp element (13) adapted to be fitted to a second, mitred-end, frame member (2), the second clamp element (13) having:

a finger (24) arranged to extend, in use, beyond the mitred-end of the second frame member (2) and having:

an oblique surface (27) at least partially directed, in use, transverse to a mitred-end face (8) of the second frame member (2) and a second fastening provision (25) arranged, in use, complementarily to the first fastening provision (19) for urging the clamp elements (12,13) towards each other in a fastening direction via action of the fastener (31) engaging the fastening provisions (19, 24), the arrangement being such that upon fastening, the oblique surfaces (17, 27) co-operate to move the clamp elements (12,13) orthogonally of the fastening direction to close the faces (8) of the two mitred-end, frame members (2, 3) against each other, and wherein at least one of the clamp elements is provided with a panel-abutment formation (22) adapted and arranged to abut a panel (4) in a mitred corner frame for adjustment of frame squareness;

wherein the clamp in combination with respective mitred-end frame members (2,3), the clamp elements have their lengths parallel with lengths of the respective frame members; wherein the clamp in combination with respective mitred-end frame members (2,3) further include:

four said mitred-end frame members;

four said first clamp elements;

four said second clamp elements; and a panel and a panel surrounding seal;

wherein the frame members are arranged as a frame around the panel and clamped together with the clamp elements;

wherein the clamped frame and panel is a fixed side or a door of a shower enclosure; and wherein the clamped frame and panel is in combination with:

a wall securement channel member (43,45) and a channel fixing screw (53) and a frame receiving channel (41), the wall securement channel and the frame receiving channel being provided with mutually co-operating formations for holding a vertical one of the members of the frame at least partially in the frame receiving channel.

* * * * *